US007628654B2

(12) United States Patent
Hori et al.

(10) Patent No.: US 7,628,654 B2
(45) Date of Patent: Dec. 8, 2009

(54) CARD EDGE CONNECTOR AND METHOD OF MANUFACTURING THE SAME

(75) Inventors: Masashi Hori, Anjo (JP); Taku Iida, Nagoya (JP); Yasushi Matsumura, Toyota (JP); Yoshio Hironaka, Nukata-gun (JP); Takashi Kamiya, Okazaki (JP); Masashi Hiramatsu, Okazaki (JP); Toshihiro Miyake, Inuyama (JP); Hiroki Kamiya, Nagoya (JP)

(73) Assignees: Nippon Soken, Inc., Nishio (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 12/292,494

(22) Filed: Nov. 20, 2008

(65) Prior Publication Data

US 2009/0191760 A1 Jul. 30, 2009

(30) Foreign Application Priority Data

Jan. 25, 2008 (JP) ..... 2008-015471

(51) Int. Cl.
*H01R 24/00* (2006.01)

(52) U.S. Cl. ..... 439/637

(58) Field of Classification Search ..... 439/637, 439/634, 668, 60

See application file for complete search history.

(56) References Cited

U.S. PATENT DOCUMENTS 3,852,700 A * 12/1974 Haws ..... 439/98
5,239,748 A 8/1993 Hamilton
5,348,491 A * 9/1994 Louwagie et al. ..... 439/188
6,086,427 A * 7/2000 Cahaly ..... 439/631
6,830,486 B2 * 12/2004 Norris et al. ..... 439/668
6,851,953 B2 * 2/2005 Kamiyamane ..... 439/59
7,369,415 B2 5/2008 Kojima
7,524,211 B2 * 4/2009 Norris et al. ..... 439/668

FOREIGN PATENT DOCUMENTS

JP U-5-43489 6/1993
JP U-6-86366 12/1994
JP A-11-003753 1/1999

(Continued)

OTHER PUBLICATIONS

U.S. Appl. No. 12/292,500, filed Nov. 20, 2008, Hori et al.

*Primary Examiner*—T C Patel
*Assistant Examiner*—Harshad C Patel
(74) *Attorney, Agent, or Firm*—Posz Law Group, PLC

(57) ABSTRACT

A card edge connector includes a housing, a first conductive part, a second conductive part, a supporting conductive part, a connecting element, a first harness, and a second harness. The housing has an insertion hole for receiving an electronic substrate therein. The first conductive part and the second conductive part are disposed in the insertion hole and are configured to come in contact with respective terminals disposed on a surface of the electronic substrate. The supporting conductive part is disposed in the housing in such a manner that supporting conductive part is farther away from the surface of the electronic substrate than the first conductive part is. The connecting element couples the second conductive part and the supporting conductive part, the first harness is coupled with the first conductive part, and the second harness is coupled with the supporting conductive part.

13 Claims, 4 Drawing Sheets

FOREIGN PATENT DOCUMENTS

| | | |
|---|---|---|
| JP | A-2000-164273 | 6/2000 |
| JP | A-2000-214214 | 8/2000 |
| JP | A-2001-230032 | 8/2001 |
| JP | A-2003-178834 | 6/2003 |
| JP | A-2004-47331 | 2/2004 |
| JP | A-2004-134214 | 4/2004 |
| JP | A-2004-273129 | 9/2004 |

* cited by examiner

CARD EDGE CONNECTOR AND METHOD OF MANUFACTURING THE SAME

CROSS REFERENCE TO RELATED APPLICATIONS

The present application is based on and claims priority to Japanese Patent Application No. 2008-15471 filed on Jan. 25, 2008, the contents of which are incorporated in their entirety herein by reference.

BACKGROUND OF THE INVENTION

1. Field of the Invention

The present invention relates to a card edge connector and a method of manufacturing a card edge connector.

2. Description of the Related Art

JP-A-2000-164273 discloses a connector that includes a housing and a plurality of terminals protruding from the housing. One end portions of the terminals are soldered with respective lands on a circuit board. The other end portions of the terminals are configured to be connected with an external connector. The other end portions of the terminals are arranged in a plurality of steps in a direction vertical to a planer direction of the circuit board in addition to the planer direction of the circuit board so that a width of the connector in the planer direction of the circuit board is reduced.

In the connector, each of the terminals is required to be soldered with the corresponding land on the circuit board. Thus, the number of components and the number of manufacturing process increase. In addition, when the circuit board is discarded, a segregated disposal of the circuit board requires time and effort.

In view of such circumstances, JP-A-2003-178834 discloses a card edge connector that includes a housing and a plurality of connector terminals disposed in the housing. In the present case, a plurality of contact terminals is disposed on a surface of a circuit board. When the circuit board is inserted into the housing, the contact terminals come in contact with the connector terminals, and thereby the contact terminals and the connector terminals are electrically coupled with each other.

In the card edge connector, the connector terminals are arranged in the housing so that the connector terminals can come in contact with the contact terminals disposed on the surface of the circuit board. Thus, the connector terminals are difficult to be arranged in a plurality of steps in a direction vertical to a planer direction of the circuit board.

JP-U-6-86366 discloses a card edge connector in which connector terminals are arranged in a plurality of steps in a direction vertical to a planer direction of a circuit board. The circuit board includes a multilayered substrate. An end portion of an inner substrate extends to an outside of an end portion of an outer substrate, and a plurality of terminals is disposed at the end portion of the inner substrate and the end portion of the outer substrate. Thus, a step is provided between an inner card edge part formed at the end portion of the inner substrate and an outer card edge part formed at the end portion of the outer substrate. In the card edge connector, a plurality of connector terminals are arranged in a plurality of steps in the direction vertical to the planer direction of the circuit board so as to correspond to the terminals of the circuit board.

In a case where the step is provided by using a thickness of one substrate in the multilayered substrate, it is difficult to provide a step having an enough height. Thus, the connector terminals of the card edge connector are formed into a shape fitted into a height of the step and the connector terminals are required to be closely arranged. As a result, a short circuit may occur.

SUMMARY OF THE INVENTION

In view of the foregoing problems, it is an object of the present invention to provide a card edge connector. Another object of the invention is to provide a method of manufacturing a card edge connector.

A card edge connector according to an aspect of the invention includes a housing, a first conductive part, a second conductive part, a supporting conductive part, a connecting element, a first harness, and a second harness. The housing has an insertion hole for receiving an end portion of an electronic substrate therein. The electronic substrate includes a first terminal and a second terminal disposed on a surface of the end portion, and the first terminal is located in front of the second terminal in an insertion direction that the end portion of the electronic substrate is inserted into the card edge connector. The first conductive part is disposed in the insertion hole and is configured to come in contact with the first terminal when the end portion of the electronic substrate is received by the housing. The first conductive part is located at a first distance from the surface of the electronic substrate in a direction approximately vertical to the planer direction of the electronic substrate when the electronic substrate is received by the housing. The second conductive part is disposed in the insertion hole and is configured to come in contact with the second terminal when the electronic substrate is received by the housing. The supporting conductive part is disposed in the housing and is located at a second distance from the first surface of the electronic substrate in the direction approximately vertical to the planer direction of the electronic substrate when the end portion of the electronic substrate is received by the housing. The second distance is larger than the first distance. The connecting element couples the second conductive part and the supporting conductive part. The first harness is coupled with the first conductive part and protrudes to an outside of the housing. The second harness is coupled with the supporting conductive part and protrudes to an outside of the housing.

In the present card edge connector, the first conductive part and the supporting conductive part can be arranged in the direction approximately vertical to the planer direction of the electronic substrate so as to have a predetermined distance between the first conductive part and the supporting conductive part.

In a method according to another aspect of the invention, a card edge connector adapted to receive an electronic substrate is manufactured. In the method, a first harness is coupled with a first conductive part. A second harness is coupled with a supporting conductive part. A connecting element is coupled with a second conductive part. The first conductive part coupled with the first harness is disposed in a first cavity of a first housing. The supporting conductive part coupled with the second harness is disposed in a storage cavity of the first housing. The second conductive part coupled with the connecting element is disposed in a second cavity of a second housing in such a manner that the connecting element protrudes to an outside of the second housing through a through hole of the second housing. The first housing is fitted with the second housing in such a manner that the first cavity communicates with the second cavity so as to configurate an insertion hole for receiving the electronic substrate therein and the storage cavity communicates with the through hole. The connecting element is contacted with the supporting conductive part.

In the present manufacturing method, the first conductive part and the supporting conductive part can be arranged in a direction approximately vertical to a planer direction of the electronic substrate so as to have a predetermined distance between the first conductive part and the supporting conductive part.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

Figure 1:
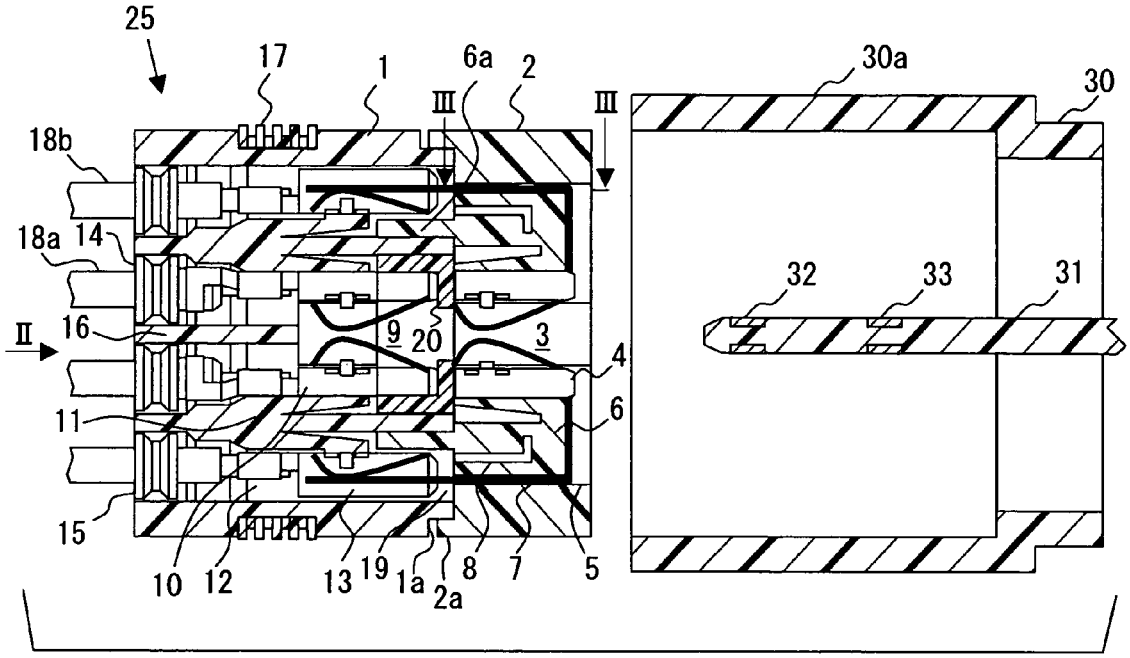
FIG. 1 is a cross-sectional view illustrating a card edge connector according to an exemplary embodiment of the invention.

A card edge connector 25 according to an exemplary embodiment of the invention will be described with reference to FIG. 1-FIG. 3. The card edge connector 25 includes a first housing 1 and a second housing 2. The first housing 1 and the second housing 2 are formed by resin injection molding, for example. The first housing 1 and the second housing 2 are fitted with each other in such a manner that a contact surface of the first housing 1 is in contact with a contact surface of the second housing 2. At a peripheral edge portion of the contact surface of the second housing 2, a protruding part 2*a* is provided. At a peripheral edge portion of the contact surface of the first housing 1, a recess part 1*a* is provided. The first housing 1 and the second housing 2 are fixed to each other by fitting the protruding part 2*a* of the second housing 2 into the recess part 1*a* of the first housing 1.

The first housing 1 has a first cavity 9 and the second housing 2 has a second cavity 3. The first cavity 9 communicates with the second cavity 3 so as to configurate an insertion hole for receiving an electronic substrate 31 therein. The electronic substrate 31 is inserted into the insertion hole from the second cavity 3 to the first cavity 9.

The electronic substrate 31 is housed in a substrate housing 30. At an end portion of the substrate housing 30, a cover 30*a* is provided. The first housing 1 and the second housing 2 are fitted into the cover 30*a*. The electronic substrate 31 extends to an inside of the cover 30*a*. The electronic substrate 31 has a upper surface and a lower surface. At an end portion of each of the upper surface and the lower surface, a plurality of front terminals 32 and a plurality of inner terminals 33 are disposed. The front terminals 32 are located in front of the inner terminals 33 in an insertion direction that the electronic substrate 31 is inserted into the insertion hole of the card edge connector 25. The front terminals 32 are arranged on each of the upper surface and the lower surface of the electronic substrate 31 in a direction approximately perpendicular to the insertion direction of the electronic substrate 31. The inner terminals 33 are also arranged on each of the upper surface and the lower surface of the electronic substrate 31 in a direction approximately perpendicular to the insertion direction. In the electronic substrate 31 illustrated in FIG. 1, the inner terminals 33 are arranged in one row on each of the upper surface and the lower surface. Alternatively, the inner terminals 33 may be arranged in a plurality of rows on each of the upper surface and the lower surface.

In the first cavity 9 of the first housing 1, a plurality of first connector pins 10 is disposed. Each of the first connector pins 10 corresponds to a first conductive part. The first connector pins 10 are arranged so as to correspond to the respective front terminals 32 disposed on each of the upper surface and the lower surface of the electronic substrate 31. When the electronic substrate 31 is inserted into the first cavity 9, the electronic substrate 31 is interposed between the first connector pins 10 located on an upper side of the first cavity 9 and the first connector pins 10 located on a lower side of the first cavity 9. The first housing 1 has a first partition 16. The first partition 16 divides a space where the first connector pins 10 are disposed into two. The first connector pins 10 are inserted into the first housing 1 from an opposite side of the contact surface of the first housing 1.

The first connector pins 10 are made of a metal having a high electronic conductivity, for example, a copper alloy. As illustrated in FIG. 1, each of the first connector pins 10 includes a joint section, a body section, and a contact element. The joint section is joined with a first harness 18*a*, for example, by press fitting or caulking. The body section extends from the joint section and has an approximately cylinder shape. The contact element is held by the body section. The contact element is elastically deformable so as to come in contact with the corresponding front terminal 32 of the electronic substrate 31 at a predetermined pressure. The body section has a stopper that prevents an excess deformation of the contact element. The first housing 1 further has second partitions 11 for dividing the first cavity 9 and two storage cavities 12. Each of the second partitions 11 has first projections 11*a* on one surface thereof and second projections 11*b* on the other surface thereof. Each of the first connector pins 10 has a hole. Each of the first projections 11*a* is fitted into the hole of the corresponding first connector pin 10. Thereby, each of the first connector pins 10 is fixed at a predetermined position.

The first harnesses 18*a* are attached with individual seals 14. The individual seals 14 are press-fitted into respective seal-housing parts provided at an end portion of the first housing 1. The individual seals 14 prevent moisture and the like from seeping to the first housing 1 from a clearance between each of the first harnesses 18*a* and the first housing 1. The individual seals 14 are separated for each of the first harnesses 18*a* as illustrated in FIG. 2. The individual seals 14 are attached to the respective first harnesses 18*a* before the first connecter pins 10 are joined with the first harnesses 18*a*. Thus, the first connector pins 10 are not required to be inserted into the respective individual seals 14 when the first connector pins 10 are inserted into the first housing 1. Thus, the contact elements of the first connector pins 10 are prevented from being attached with oil in the individual seals 14, and an electric connectivity between the contact elements of the first connector pins 10 and the front terminals 32 are not reduced.

The first housing 1 has the storage cavities 12 on an upper side and a lower side of the first cavity 9. In each of the storage cavities 12, a plurality of third connector pins 13 is disposed.

Each of the third connector pins 13 corresponds to a supporting conductive part. Each of the storage cavities 12 opens on the contact surface of the first housing 1 and the opening portion becomes a connecting-element insertion hole 19. Each of the third connector pins 13 includes a joint section, a body section, and a contact element in a manner similar to the first connector pins 10. Each of the contact elements of the third connector pins 13 is also elastically deformable. Each of the third connector pins 13 has a hole at the body section thereof. The second projections 11*b* provided on the surfaces of the second partitions 11 are fitted into the respective holes of the third connector pins 13. Thereby, each of the third connector pins 13 is fixed at a predetermined position.

In each of the first connector pins 10, the contact element is located at an outside of the body section. In each of the third connector pins 13, the contact element is located at an inside of the body section. The third connector pins 13 are joined with respective second harnesses 18*b*. As illustrated in FIG. 2, the second harnesses 18*b* that are joined with the respective third connector pins 13 located on the upper side of the first connector pins 10 are attached with an integrated seal 15. In addition, the second harnesses 18*b* that are joined with the respective third connector pins 13 located on the lower side of the first connector pins 10 are attached with another integrated seal 15. That is, the integrated seals 15 are not separated for each of the second harnesses 18*b* and each of the integrated seals 15 is integrated for a plurality of the second harnesses 18*b*. The integrated seals 15 are attached to the first housing 1 before the third connector pins 13 joined with the respective second harnesses 18*b* are inserted into the corresponding storage cavity 12. Thus, the third connector pins 13 are inserted into the corresponding storage cavity 12 through the corresponding integrated seal 15. By using the integrated seals 15, a distance between the second harnesses 18*b* can be reduced and the third connector pins 13 can be arranged with a high density.

On an external surface of the first housing 1, a sealing member 17 having a ring shape is disposed. The sealing member 17 is made of silicon rubber, for example. When the first housing 1 and the second housing 2 of the card edge connector 25 are fitted into the cover 30*a* of the substrate housing 30, the sealing member 17 prevents moisture and the like from seeping into the substrate housing 30 from a clearance between an inner surface of the cover 30*a* and the external surfaces of the first housing 1 and the second housing 2.

In the second cavity 3 of the second housing 2, a plurality of second connector pins 4 is disposed. Each of the second connector pins 4 corresponds to a second conductive part. The second connector pins 4 are arranged so as to correspond to the respective inner terminals 33 disposed on each of the upper surface and the lower surface of the electronic substrate 31. When the electronic substrate 31 is inserted into the second cavity 3, the electronic substrate 31 is interposed between the second connector pins 4 located on the upper side of the second cavity 3 and the second connector pins 4 located on the lower side of the second cavity 3. Each of the second connector pins 4 includes a body section and a contact element. In addition, each of the second connector pins 4 is coupled with a connecting element 5. Each of the connecting elements 5 has an approximately L-shape, for example. As illustrated in FIG. 1, each of the connecting elements 5 extends from an end of the corresponding body section located on a side where the electronic substrate 31 is inserted, and each of the connecting elements 5 extends approximately vertically in a direction away from the electronic substrate 31 to a position corresponding to a arranging position of the contact element of the corresponding third connector pin 13. At this position, each of the connecting elements 5 is bent in a direction toward the first housing 1, and each of the connecting elements extends to the corresponding third connector pin 13 through the second housing 2. Thus, each of the connecting elements 5 coupled with the corresponding second connector pin 4 is configured to come in contact with the contact element of the corresponding third connector pin 13.

The second connector pins 4 and the connecting elements 5 are inserted into the second housing 2 from the side where the electronic substrate 31 is inserted. The second housing 2 includes a holding part 6 that holes the second connector pins 4. The holding part 6 has a plurality of through holes 7 into which the connecting elements 5 are inserted respectively. Each of the through holes 7 communicate with the corresponding storage cavity 12 through the corresponding connecting-element insertion hole 19. Thus, each of the connecting elements 5 extends from the second cavity 3 to the corresponding storage cavity 12 through the corresponding through hole 7 and the corresponding connecting-element insertion hole 19. The holding part 6 has a plurality of projects at a surface facing the second cavity 3. The projections are inserted into holes provided at the body sections of the second connector pins 4. Thereby, the second connector pins 4 are fixed to the holding part 6.

Figure 3:
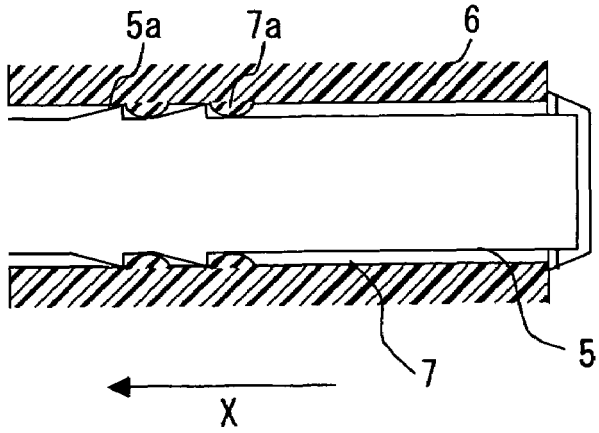
FIG. 3 is an enlarged cross-sectional view illustrating a part of the card edge connector taken along line III-III in FIG. 1.

As illustrated in FIG. 3, each of the connecting elements 5 has a plurality of barbs 5*a*. Each of the barbs 5a has an approximately triangle shape having a steep inclination angle in an opposite direction of an insertion direction shown by the arrow X. In an inner surface of the through holes 7, a plurality of projections 7*a* is provided. Thus, even if each of the connecting elements 5 receives a resistance when each of the connecting elements 5, which protrudes from the second housing 2, is inserted into the corresponding connecting-element insertion hole 19, each of the connecting elements 5 is prevented from being dropped from the second housing 2 and an electronic connectivity is ensured.

The holding part 6 has a plurality of protruding portions 6*a* that functions as a guide. By sliding each of the protruding portions 6*a* along the corresponding second partition 11, the second housing 2 can be fitted with the first housing 1 so as to have a predetermined positional relationship and the protruding part 2*a* of the second housing 2 is fitted into the recess part 1*a* of the first housing 1.

The second housing 2 is formed by resin injection molding. When the resin injection molding is performed, metal plates 8 are insert-molded in the holding part 6 that holds the second connector pins 4. Because the metal plates 8 are insert-molded in the holding part 6 and the metal plates 8 are located adjacent to the second connector pins 4, the metal plates 8 can improve the strength of the holding part 6 that is a part of the second housing 2. Thus, the holding part 6 is restricted from being creep-deformed and a contact pressure between the contact elements of the second connector pins 4 and the inner terminals 33 of the electronic substrate 31 is restricted from being reduced. The metal plates 8 may also be insert-molded in the first housing 1 so as to be located adjacent to the first connector pins 10 and/or the third connector pins 13.

In the first cavity 9 of the first housing 1, a supporting member 20 is disposed for stably fixing the first connector pins 10 and the second connector pins 4. The supporting member 20 has an open box shape. The supporting member 20 has a through hole at a bottom portion thereof so that the electronic substrate 31 is inserted into the first cavity 9 from the through hole. An inner side surface and an inner bottom surface of the supporting member 20 are in contact with a side surface of the body sections of the first connector pins 10 and end surfaces of the first connector pins 10, respectively. An outer side surface of the supporting member 20 is in contact with end surfaces of the second connector pins 4.

An exemplary method of manufacturing the card edge connector 25 will be described with reference to FIG. 4A-FIG. 4D. At a process illustrated in FIG. 4A, the first harnesses 18*a* are coupled with the respective first connector pins 10. The second harnesses 18*b* are coupled with the respective third connector pins 13. The connecting elements 5 are coupled with the respective second connector pins 4.

Figure 4A:
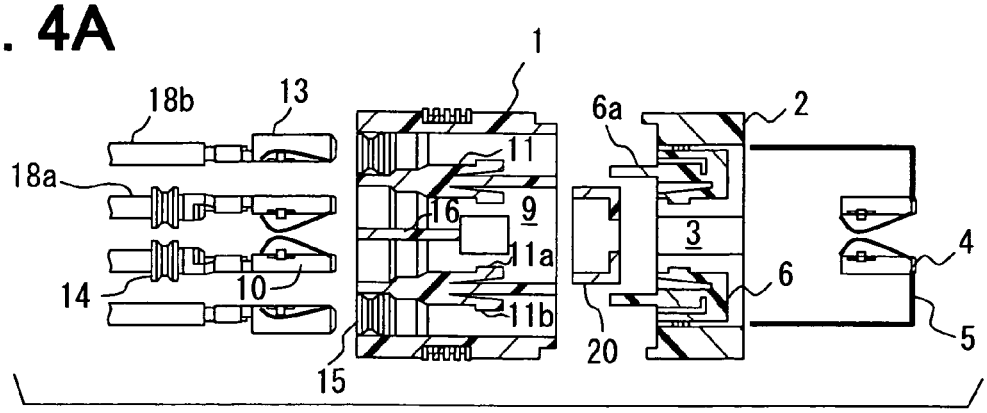
FIG. 4A-FIG. 4D are cross-sectional views illustrating an exemplary manufacturing process of the card edge connector.
Figure 4B:
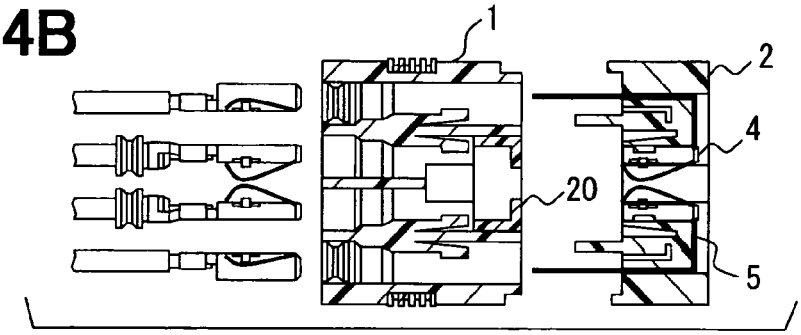

Then, as illustrated in FIG. 4B, the second connector pins 4 coupled with the respective connecting elements 5 are inserted into the second housing 2 from a side opposite to the contact surface of the second housing 2. Thereby, the second connector pins 4 are fixed to the holding part 6 of the second housing 2 and the connecting elements 5 protrude from the contact surface of the second housing 2 through the through holes 7 provided at the holding part 6. In addition, the supporting member 20 is inserted into the first cavity 9 in the first housing 1. The supporting member 20 is temporarily fixed in the first cavity 9 in the first housing 1 by being held between the two second partitions 11.

Figure 4C:
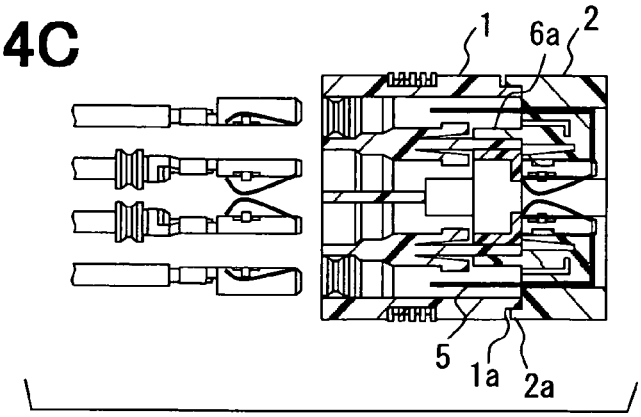

Next, as illustrated in FIG. 4C, the contact surface of the second housing 2 is contacted with the contact surface of the contact surface of the first housing 1, and the second housing 2 is fitted with the first housing 1. At this time, the protruding portions 6*a* of the holding part 6 are slid on the corresponding second partition 11 so as to function as the guide. In addition, the connecting elements 5 are inserted into the first housing 1 through the insertion holes 19. The connecting elements 5 have the barbs 5*a* and the projections 7*a* are provided at the inner surface of the through holes 7. Thus, even if the connecting elements 5 receives a pressure when the connecting elements 5 are inserted or when the third connector pins 13 are inserted, the connecting elements 5 and the second connector pins 4 are prevented from being dropped from the second housing 2.

Figure 4D:
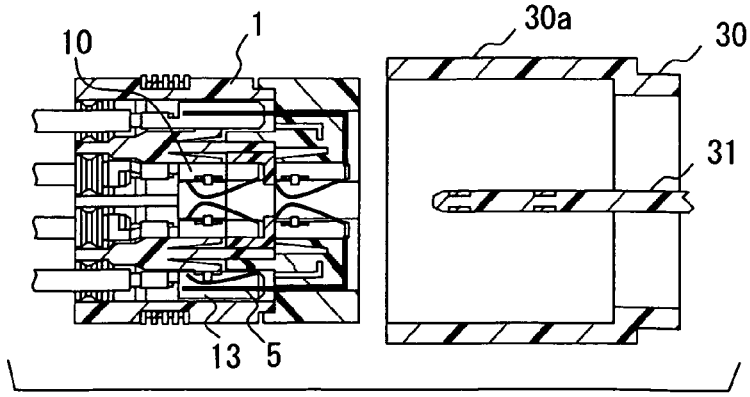

Next, as illustrated in FIG. 4D, the first connector pins 10 and the third connector pins 13 are inserted into the first housing 1 from an opposite side of the contact surface of the first housing 1. At this time, the first harnesses 18*a* are attached with the individual seals 14. Thus, the first connector pins 10 are inserted into the first housing 1 without being inserted into the individual seals 14. The integrated seals 15 to be attached with the second harnesses 18*b* are preliminarily press-fitted into the first housing 1. The third connector pins 13 are inserted into the first housing 1 through the corresponding integrated seal 15.

The holes of the body section of the first connector pins 10 are fitted with the first projection 11*a* of the second partitions 11 and the holes the body section of the third connector pins 13 are fitted with the second projection 11*b* of the second partitions 11. Thereby, the first connector pins 10 and the third connector pins 13 are fixed to the second partitions 11. At this time, the contact elements of the third connector pins 13 are in contact with the connecting elements 5 at the predetermined contact pressure, and thereby electric connections between the third connector pins 13 and the connecting elements 5 are ensured.

Figure 2:
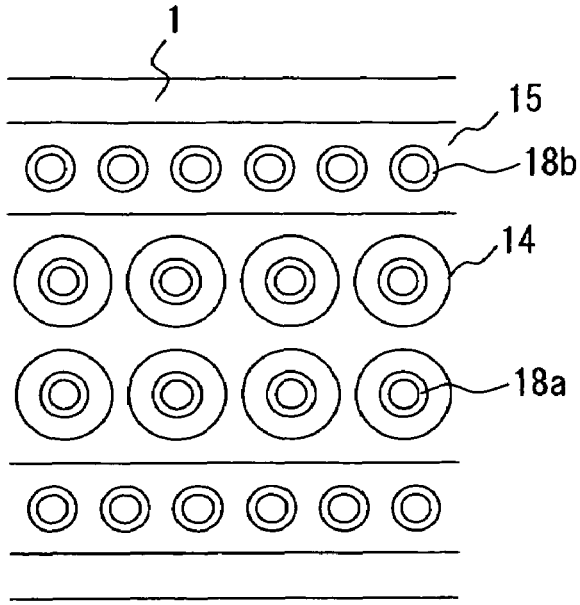
FIG. 2 is a side view illustrating the card edge connector viewed from a direction of arrow II in FIG. 1.

In this way, the card edge connector 25 illustrated in FIG. 1 is manufactured. In the above-described method, the second housing 2 is fixed to the first housing 1 before the first connector pins 10 and the third connector pins 13 are inserted into the first housing 1. The second housing 2 may also be fixed to the first housing 1 after the first connector pins 10 and the third connector pins 13 are inserted into the first housing 1 and are arranged at predetermined positions. Alternatively, the first connector pins 10, the second connector pins 4, and the third connector pins 13 may be inserted into the corresponding housing 1 or 2 after the first housing 1 and the second housing 2 are fixed to each other.

In the present card edge connector 25, the first connector pins 10 are configured to come in contact with the respective front terminals 32 when the electronic substrate 31 is received by the first housing 1 and the second housing 2. The second connector pins 4 are configured to come in contact with the respective inner terminals 33 when the electronic substrate 31 is received by the first housing 1 and the second housing 2. The first connector pins 10 located on the upper side of the first cavity 9 and the second connector pins 4 located on the upper side of the second cavity 3 are located in a plan approximately parallel to the planer direction of the electronic substrate 31. In addition, the first connector pins 10 located on the lower side of the first cavity 9 and the second connector pins 4 located on the lower side of the second cavity 3 are located in a plan approximately parallel to the planer direction of the electronic substrate 31.

The second connector pins 4 and the third connector pins 13 are electrically coupled through the connecting elements 5. In the direction approximately vertical to the planer direction of the electronic substrate 31, a distance between the third connector pins 13 and the surfaces of the electronic substrate 31 is larger than a distance between the first connector pins 10 and the surfaces of the electronic substrate 31 when the electronic substrate 31 is received by the first housing 1 and the second housing 2. Thus, even if the front terminals 32 and the inner terminals 33 are disposed along the insertion direction of the electronic substrate 31, the first connector pins 10 and the third connector pins 13, which are electrically coupled with the front terminals 32 and the inner terminals 33, respectively, can be arranged in a plurality of steps in the direction approximately vertical to the planer direction of the electronic substrate 31, and a predetermined distance can be provided between the first connector pins 10 and the third connector pins 13.

Other Embodiments

Although the present invention has been fully described in connection with the preferred embodiments thereof with reference to the accompanying drawings, it is to be noted that various changes and modifications will become apparent to those skilled in the art.

Figure 5A:
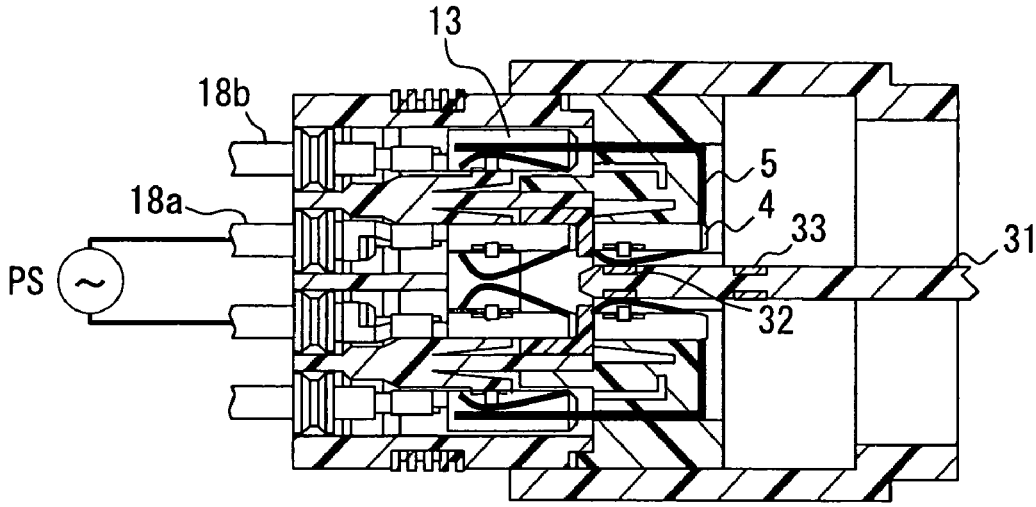
FIG. 5A is a cross-sectional view illustrating a card edge connector according to a modification of the invention and FIG. 5B is a cross-sectional view illustrating a card edge connector according to another modification of the invention.
Figure 5B:
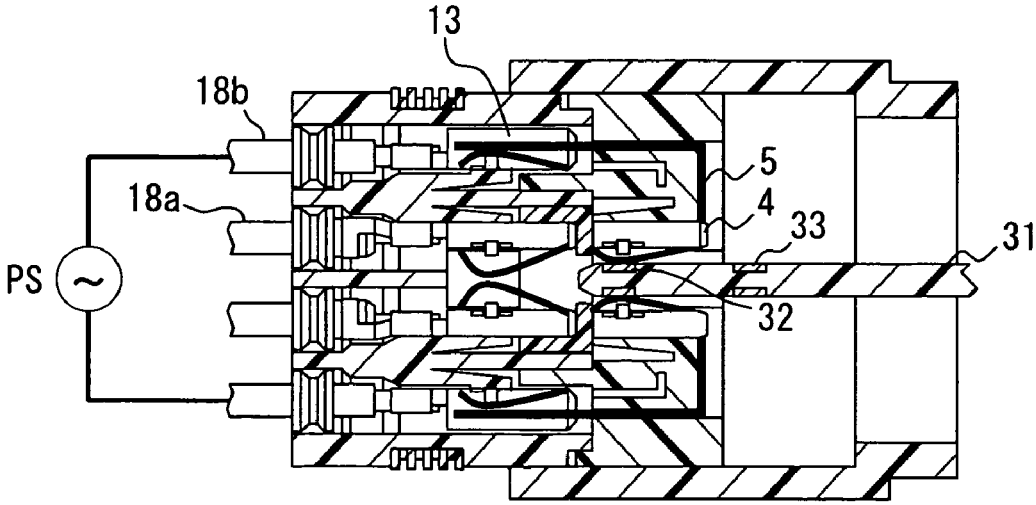

For example, the first harnesses 18*a* joined with the first connector pins 10 may be coupled with a power source (PS) as illustrated in FIG. 5A. In the present case, electricity can be supplied from the power source to a circuit formed on the electronic substrate 31 through the first connector pins 10 and the front terminals 32 when the electronic substrate 31 is completely inserted into the card edge connector 25 and the first connector pins 10 come in contact with the front terminals 32. In a case where the second harnesses 18*b* joined with the third connector pins 13 are coupled with the power source, as illustrated in FIG. 5B, electricity can possibly flow through unintended pathway, i.e., through the third connector pins 13, the second connector pins 4, and the front terminals 32, before the electronic substrate 31 is completely inserted into the card edge connector 25 and the second connector pins 4 come in contact with the inner terminals 33.

In the above-described embodiment, the front terminals 32 and the inner terminals 33 are disposed on both of the upper surface and the lower surface of the electronic substrate 31. The first connector pins 10 and the third connector pins 13 are arranged in two steps in the direction approximately vertical to the planer direction of the electronic substrate 31 so as to correspond to the front terminals 32 and the inner terminals 33 disposed on the upper surface of the electronic substrate 31. In addition, the first connector pins 10 and the third connector pins 13 are arranged in two steps so as to correspond to the front terminals 32 and the inner terminals 33 disposed on the lower surface of the electronic substrate 31. The front terminals 32 and the inner terminals 33 may also be disposed only one of the upper surface and the lower surface of the electronic substrate 31. Alternatively, the front terminals 32 may be disposed on both of the surfaces, the inner terminals 33 may be disposed on one of the surfaces, and the first connector pins 10 and the third connector pins 13 may be arranged in a plurality of steps on only one side corresponding to the one of the surfaces. When the, first connector pins 10 and the third connector pins 13 are arranged in a plurality of steps, the number of step may be greater than two.

In the above-described embodiment, the third connector pins 13 are disposed in the first housing 1, as an example. The third connector pins 13 may also be arranged in the second housing 2. In the present case, a cavity is provided at the first housing and the second housing 2 so as to communicate with each other, and the third connector pins 13 is inserted into the cavity from the first-housing side to the second-housing side. Thus, the connecting elements 5, which are coupled with the second connector pins 4, are not required to protrude from the second housing 2 and the connecting elements 5 may terminate in the second housing 2.

In the above-described embodiment, a housing of the card edge connector 25 is divided into the first housing 1 and the second housing 2 in view of a manufacture. However, the housing of the card edge connector 25 may be integrally formed as long as the card edge connector 25 having the above-described structure can be manufactured.

What is claimed is:

1. A card edge connector adapted to receive an electronic substrate, the electronic substrate including a plurality of terminals disposed on an end portion of the electronic substrate, the plurality of terminals including a first terminal and a second terminal disposed on a first surface of the electronic substrate, the first terminal located in front of the second terminal in an insertion direction that the end portion of the electronic substrate is inserted into the card edge connector, the card edge connector comprising:

a housing having an insertion hole for receiving the end portion of the electronic substrate therein;

a first conductive part disposed in the insertion hole, the first conductive part configured to come in contact with the first terminal when the electronic substrate is received by the housing, the first conductive part located at a first distance from the first surface of the electronic substrate in a direction approximately vertical to the planer direction of the electronic substrate when the electronic substrate is received by the housing;

a second conductive part disposed in the insertion hole, the second conductive part configured to come in contact with the second terminal when the electronic substrate is received by the housing;

a first supporting conductive part disposed in the housing, the first supporting conductive part located at a second distance from the first surface of the electronic substrate in the direction approximately vertical to the planer direction of the electronic substrate when the end portion of the electronic substrate is received by the housing, wherein the second distance is larger than the first distance;

a first connecting element coupling the second conductive part and the first supporting conductive part;

a first harness coupled with the first conductive part and protruding to an outside of the housing; and a second harness coupled with the first supporting conductive part and protruding to an outside of the housing.

2. The card edge connector according to claim 1, wherein:

the plurality of terminals further includes a third terminal and a fourth terminal disposed on a second surface of the electronic substrate that is opposite to the first surface;

the third terminal located in front of the fourth terminal in the insertion direction, the card edge connector further comprising:

a third conductive part disposed in the insertion hole, the third conductive part configured to come in contact with the third terminal when the electronic substrate is received by the housing, the third conductive part located at the first distance from the second surface of the electronic substrate in the direction approximately vertical to the planer direction of the electronic substrate when the electronic substrate is received by the housing;

a fourth conductive part disposed in the insertion hole, the fourth conductive part configured to come in contact with the fourth terminal when the electronic substrate is received by the housing;

a second supporting conductive part disposed in the housing, the second supporting conductive part located at the second distance from the second surface of the electronic substrate in the direction approximately vertical to the planer direction of the electronic substrate when the end portion of the electronic substrate is received by the housing;

a second connecting element coupling the fourth conductive part and the second supporting conductive part;

a third harness coupled with the third conductive part and protruding to the outside of the housing; and a fourth harness coupled with the second supporting conductive part and protruding to the outside of the housing.

3. The card edge connector according to claim 1, wherein:

the plurality of terminals further includes a third terminal and a fourth terminal disposed on the first surface of the electronic substrate;

the first terminal and the third terminal are arranged in a direction approximately perpendicular to the insertion direction; and the second terminal and the fourth terminal are arranged in the direction approximately perpendicular to the insertion direction, the card edge connector further comprising:

a third conductive part disposed in the insertion hole, the third conductive part configured to come in contact with the third terminal when the electronic substrate is received by the housing, the third conductive part located at the first distance from the first surface of the electronic substrate in the direction approximately vertical to the planer direction of the electronic substrate when the electronic substrate is received by the housing;

a fourth conductive part disposed in the insertion hole, the fourth conductive part configured to come in contact with the fourth terminal when the electronic substrate is received by the housing;

a second supporting conductive part disposed in housing, the second supporting conductive part located at the second distance from the first surface of the electronic substrate in the direction approximately vertical to the planer direction of the electronic substrate when the end portion of the electronic substrate is received by the housing;

a second connecting element coupling the fourth conductive part and the second supporting conductive part;

a third harness coupled with the third conductive part and protruding to an outside of the housing;

a fourth harness coupled with the second supporting conductive part and protruding to an outside of the housing;

a first individual seal attached to the first harness so as to seal a clearance between the first harness and the housing;

a second individual seal attached to the third harness so as to seal a clearance between the third harness and the housing;

an integrated seal attached to the second harness and the fourth harness so as to seal a clearance between the second harness and the housing and a clearance between the fourth harness and the housing.

4. The card edge connector according to claim 1, further comprising a metal frame disposed in the housing and located adjacent to one of the first conductive part, the second conductive part, and the first supporting conductive part.

5. The card edge connector according to claim 1, wherein the first conductive part is configured to be coupled with a power source so that an electricity is supplied from the power source to a circuit formed on the electronic substrate through the first conductive part.

6. The card edge connector according to claim 1, wherein:

the housing includes a first housing and a second housing;

the first housing has a contact surface, a first cavity extending from the contact surface, and a storage cavity extending from the contact surface;

the second housing has a contact surface, a second cavity extending through the second housing, and a through hole extending through the second housing;

the contact surface of the first housing is in contact with the contact surface of the second housing;

the first cavity communicates with the second cavity so as to configurate the insertion hole;

the storage cavity communicates with the through hole;

the first conductive part is disposed in the first cavity;

the second conductive part is disposed in the second cavity;

the first supporting conductive part is disposed in the storage cavity; and the first connecting element extends from the second cavity to the storage cavity through the through hole.

7. The card edge connector according to claim 6, wherein the second housing has a projection on an inner surface of the through hole.

8. The card edge connector according to claim 6, wherein:

the first connecting element has a projection at an outer surface thereof; and the projection is located in the through hole.

9. The card edge connector according to claim 1, wherein the first conductive part and the second conductive part are located in a plane approximately parallel to the planer direction of the electronic substrate when the electronic substrate is received by the housing.

10. The card edge connector according to claim 1, wherein:

the first supporting conductive part includes a contact element;

the contact element is elastically deformable; and the first connecting element is in contact with the contact element.

11. A method of manufacturing a card edge connector adapted to receive an electronic substrate, the method comprising:

coupling a first harness with a first conductive part;

coupling a second harness with a supporting conductive part;

coupling a connecting element with a second conductive part;

disposing the first conductive part coupled with the first harness in a first cavity of a first housing;

disposing the supporting conductive part coupled with the second harness in a storage cavity of the first housing;

disposing the second conductive part coupled with the connecting element in a second cavity of a second housing in such a manner that the connecting element protrudes to an outside of the second housing through a through hole of the second housing;

fitting the first housing with the second housing in such a manner that the first cavity communicates with the second cavity so as to configurate an insertion hole for receiving the electronic substrate therein and the storage cavity communicates with the through hole; and contacting the connecting element with the supporting conductive part.

12. The method according to claim 11, wherein:

the first housing is formed by a resin injection molding; and a metal frame is inserted-molded when the first housing is formed so that metal frame is located adjacent to one of the first conductive part and the supporting conductive part when the one of the first conductive part and the supporting conductive part is disposed in the first housing.

13. The method according to claim 11, wherein:

the second housing is formed by a resin injection molding; and a metal frame is inserted-molded when the second housing is formed so that metal frame is located adjacent to the second conductive part when the second conductive part is disposed in the second cavity.

* * * * *